US011846427B2

(12) United States Patent
Cho et al.

(10) Patent No.: US 11,846,427 B2
(45) Date of Patent: Dec. 19, 2023

(54) GAS TURBINE COMBUSTOR WITH FUEL NOZZLES SHAPED WITH A DIAMETER DECREASING AND INCREASING TOWARD A REAR SIDE THEREOF

(71) Applicant: DOOSAN ENERBILITY CO., LTD., Changwon (KR)

(72) Inventors: Eun Seong Cho, Busan (KR); Young Jun Shin, Seongnam (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/813,946

(22) Filed: Jul. 21, 2022

(65) Prior Publication Data

US 2023/0089261 A1 Mar. 23, 2023

(30) Foreign Application Priority Data

Sep. 17, 2021 (KR) ..... 10-2021-0124573

(51) Int. Cl.
*F23R 3/28* (2006.01)
*F23R 3/46* (2006.01)

(52) U.S. Cl.
CPC ..... *F23R 3/46* (2013.01); *F23R 3/286* (2013.01); *F23R 3/28* (2013.01)

(58) Field of Classification Search
CPC ..... F23R 3/46; F23R 3/28; F23R 3/286
See application file for complete search history.

(56) References Cited

U.S. PATENT DOCUMENTS 3,659,962 A * 5/1972 Zink ..... F23D 14/64 417/198
3,684,189 A * 8/1972 Reed ..... F23D 14/64 239/425.5
3,691,762 A * 9/1972 Ryberg ..... F23R 3/12 60/39.23

(Continued)

FOREIGN PATENT DOCUMENTS

JP 61-34325 A 2/1986
JP 2010-281566 A 12/2010

(Continued)

OTHER PUBLICATIONS

JP OA No English translation provided.

*Primary Examiner* — William H Rodriguez
(74) *Attorney, Agent, or Firm* — Harvest IP Law, LLP

(57) ABSTRACT

A combustor includes an outer can into which fuel is introduced, an outer head disposed on a front side of the outer can, an inner can disposed inside of the outer can and having a combustion chamber in which a fuel-air mixture is combusted, and an inner head disposed to mix the fuel and the compressed air and supply the mixture into the inner can. The inner head includes a head plate covering a front side of the inner can, and nozzle assemblies disposed to mix the fuel and the compressed air and supply the mixture rearwards. The nozzle assembly includes a nozzle head into which fuel is introduced and nozzles. The nozzles each is coupled between the nozzle head and the head plate to mix the fuel and the compressed air and supply the mixture rearwards. The nozzles each has a shape with a diameter decreasing and increasing toward the rear side thereof.

20 Claims, 5 Drawing Sheets

(56) References Cited

U.S. PATENT DOCUMENTS 4,356,698 A * 11/1982 Chamberlain ..... F23C 6/047 60/737
4,589,260 A * 5/1986 Krockow ..... F23R 3/286 60/737
4,845,952 A 7/1989 Beebe
5,161,366 A * 11/1992 Beebe ..... F02C 3/30 60/777
5,826,429 A * 10/1998 Beebe ..... F23C 13/00 60/738
6,442,939 B1 * 9/2002 Stuttaford ..... F23D 14/64 60/737
6,460,345 B1 * 10/2002 Beebe ..... F23R 3/40 60/777
7,003,958 B2 * 2/2006 Dinu ..... F23R 3/40 60/737
7,093,438 B2 * 8/2006 Dinu ..... F23R 3/40 60/737
7,104,750 B2 * 9/2006 Bolis ..... F02C 3/30 415/117
7,509,808 B2 * 3/2009 Storey ..... F23R 3/40 60/740
7,594,400 B2 * 9/2009 Szedlacsek ..... F23C 13/06 60/777
11,674,476 B2 * 6/2023 Vise ..... F02C 5/12 60/258
2009/0133402 A1 * 5/2009 Piper ..... F23R 3/343 60/740
2011/0072824 A1 3/2011 Zuo
2011/0223551 A1 * 9/2011 Super ..... F23D 14/70 431/354
2012/0111013 A1 5/2012 Parsania
2012/0258409 A1 10/2012 Mansour
2013/0084534 A1 4/2013 Melton

FOREIGN PATENT DOCUMENTS

JP 2011-75271 A 4/2011
JP 2012-241982 A 12/2012
JP 2013-231583 A 11/2013
JP 2014-40998 A 3/2014
JP 2016-70551 A 5/2016

* cited by examiner

【Fig 1】
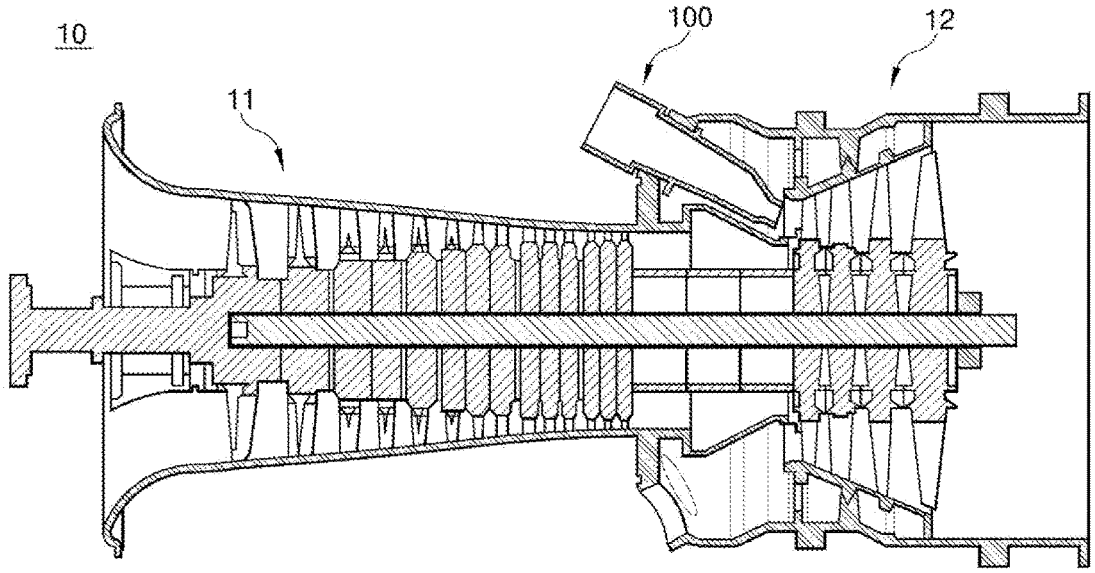
【Fig 2】
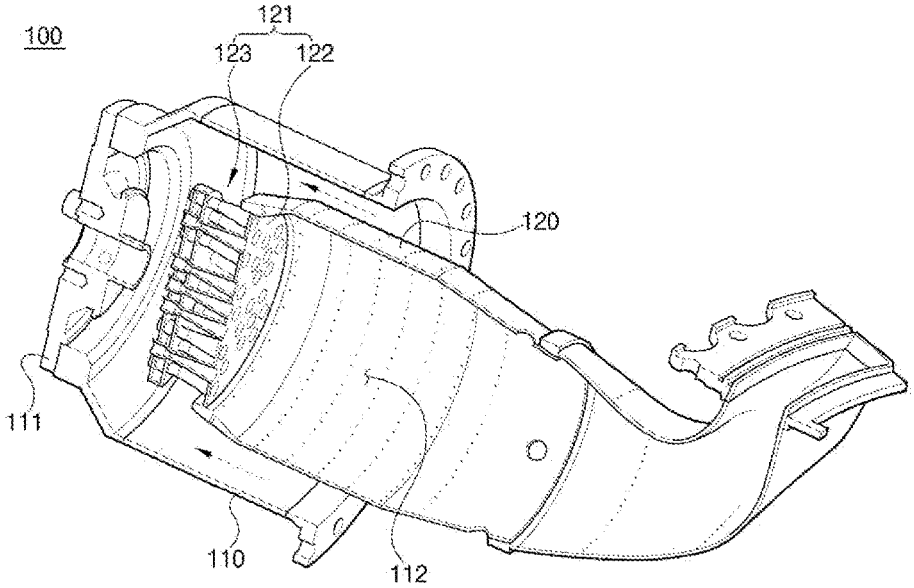

【Fig 3】
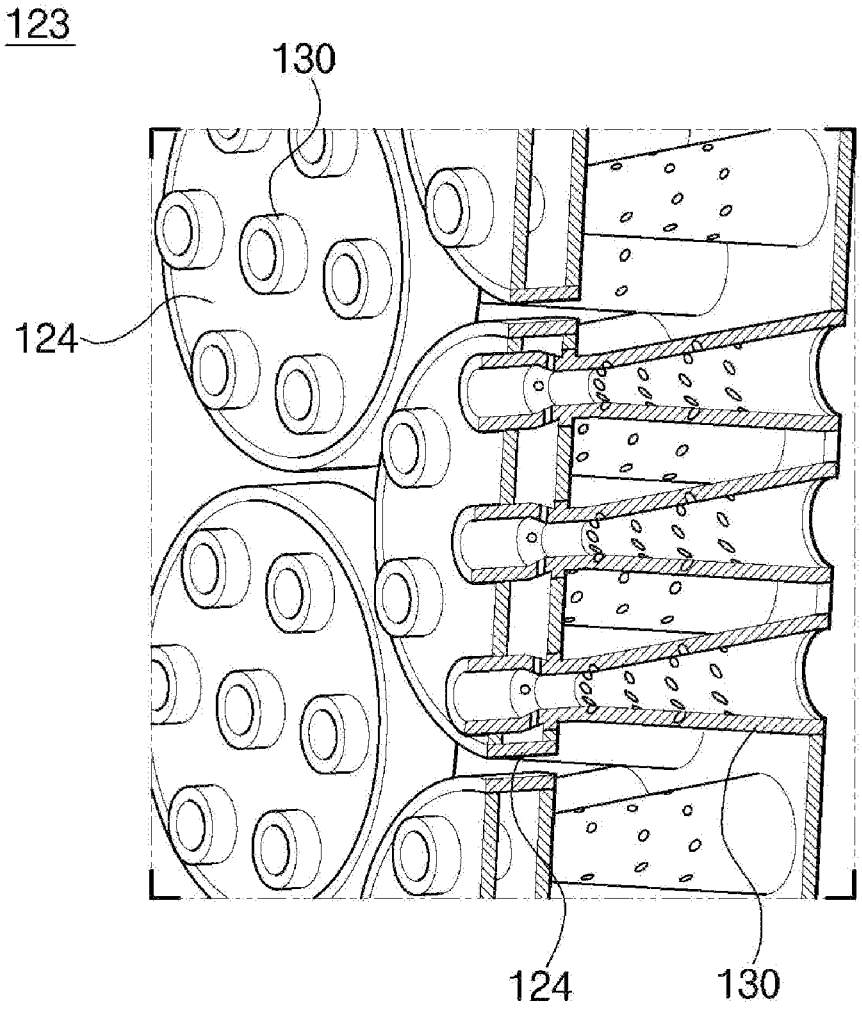

【Fig 4】
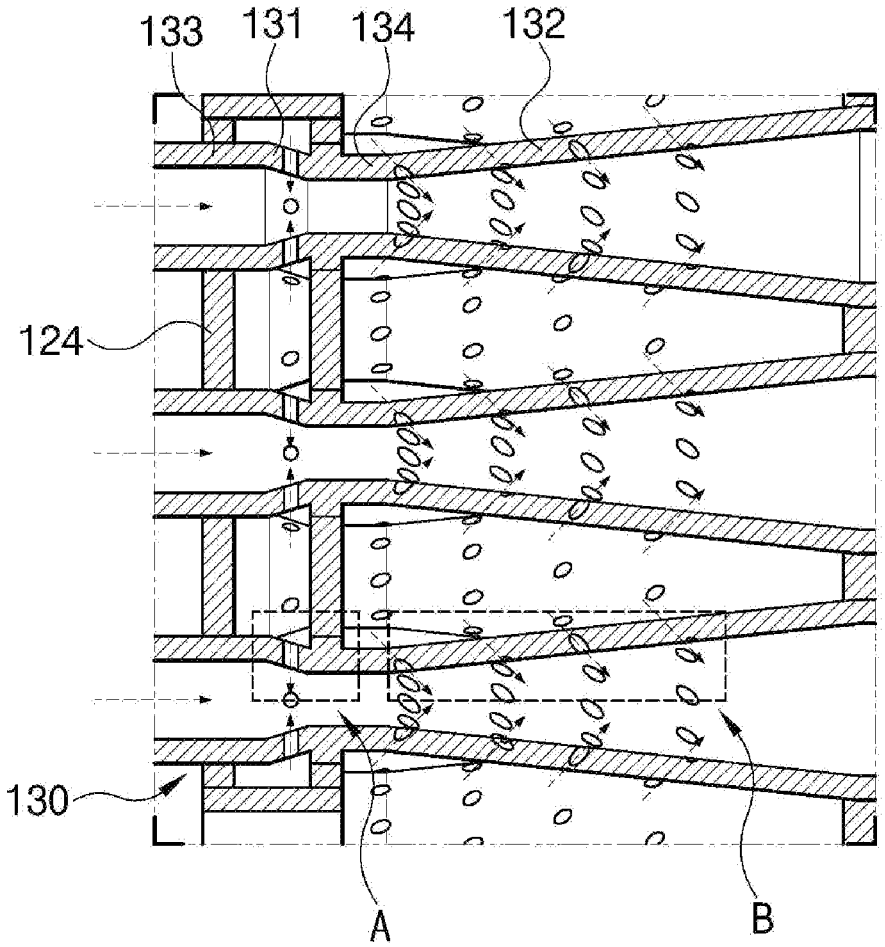

【Fig 5】
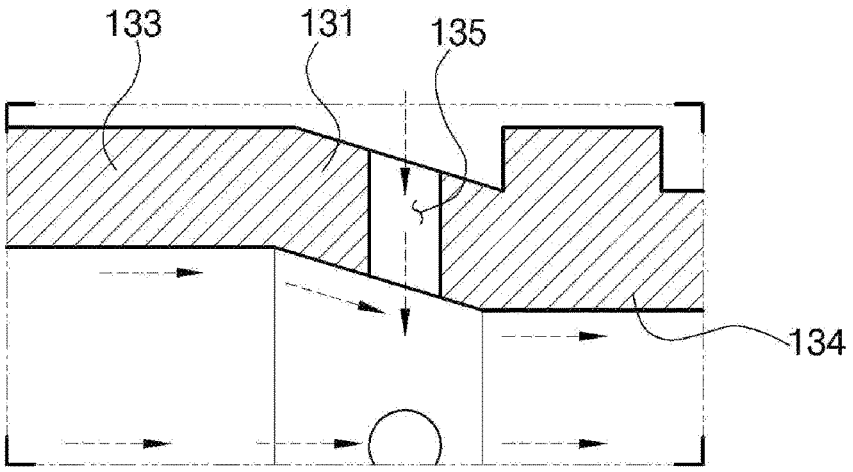
【Fig 6】
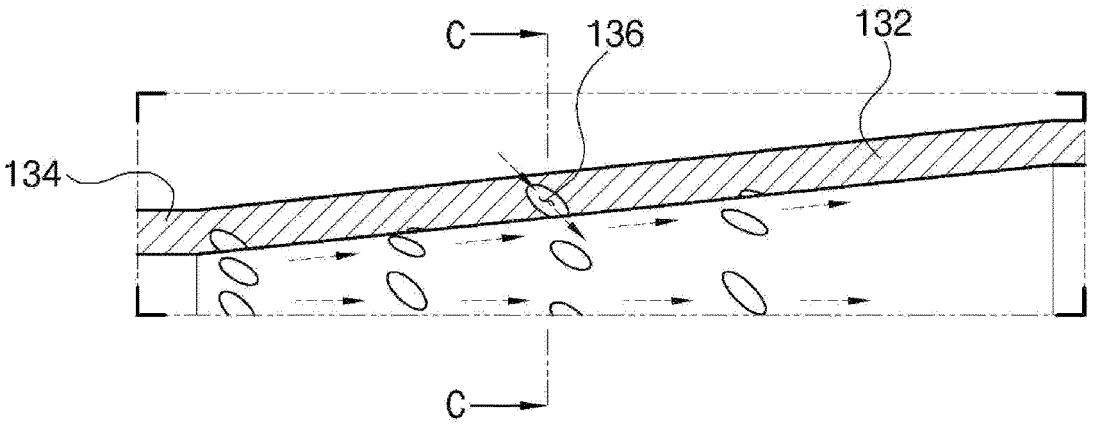

【Fig 7】
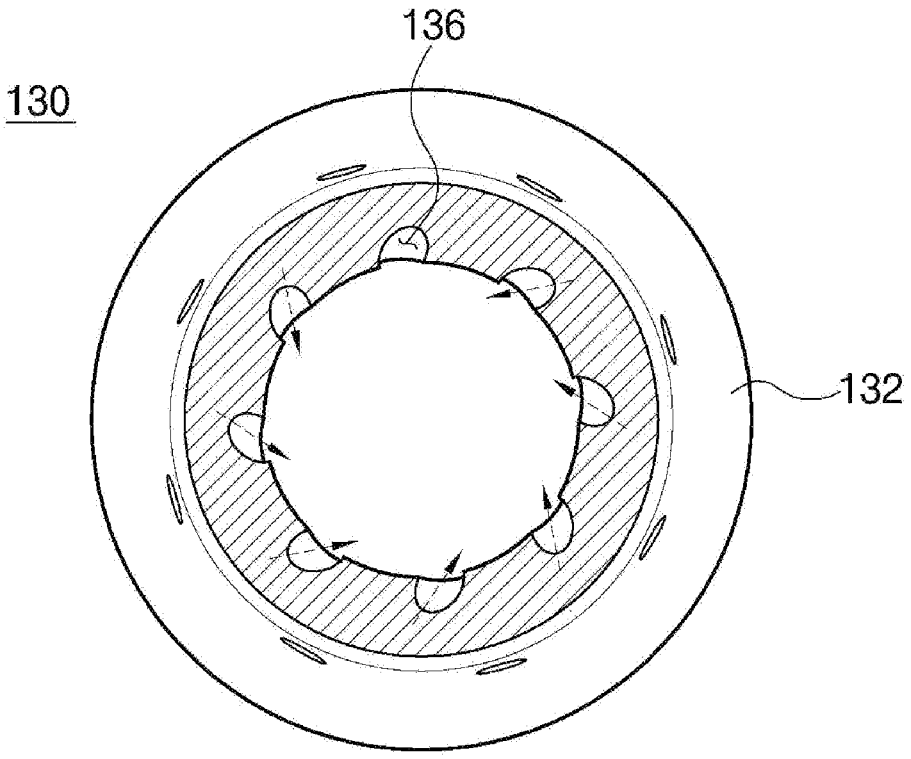
【Fig 8】
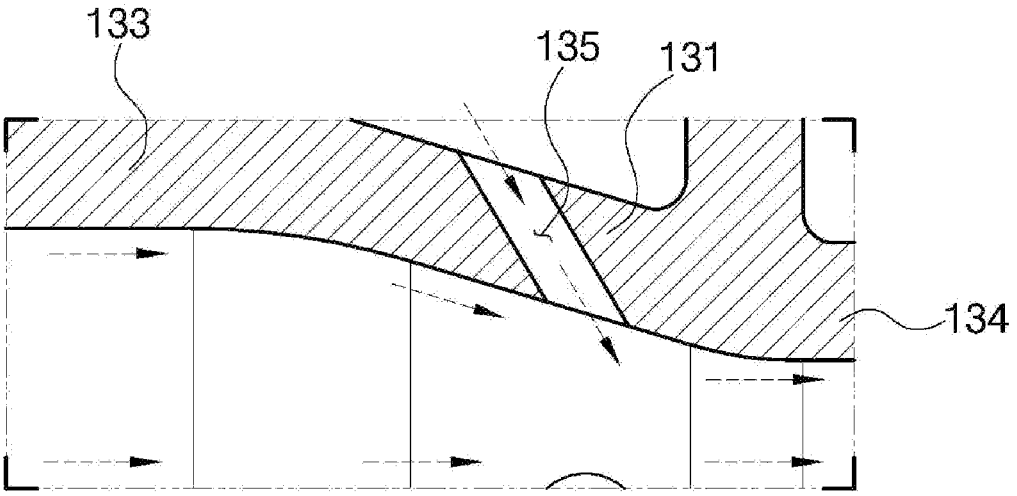

GAS TURBINE COMBUSTOR WITH FUEL NOZZLES SHAPED WITH A DIAMETER DECREASING AND INCREASING TOWARD A REAR SIDE THEREOF

CROSS REFERENCE TO RELATED APPLICATION

The present application claims priority to Korean Patent Application No. 10-2021-0124573, filed on Sep. 17, 2021, the entire contents of which are incorporated herein for all purposes by this reference.

BACKGROUND OF THE INVENTION

1. Field of the Invention

The present disclosure relates to a combustor and a gas turbine including the same and more particularly, to a combustor that mixes compressed air supplied from a compressor with fuel and combusts an air-fuel mixture, and a gas turbine through which combustion gas generated from the combustor passes to generate power for generating electric power.

2. Description of the Background Art

A turbomachine refers to an apparatus that generates power for power generation through a fluid (particularly, for example, gas) passing through the turbomachine. Therefore, the turbomachine is usually installed and used together with a generator. Such a turbomachine may include a gas turbine, a steam turbine, a wind power turbine, and the like. The gas turbine is an apparatus that mixes compressed air and natural gas and combusts an air-fuel mixture to generate combustion gas, which in turn generates power for power generation. The steam turbine is an apparatus that heats water to generate steam, which in turn generates power for power generation. The wind turbine is an apparatus that converts wind power into power for power generation.

Among the turbomachines, the gas turbine includes a compressor, a combustor, and a turbine. The compressor has a plurality of compressor vanes and compressor blades alternately arranged within a compressor casing. In addition, the compressor sucks external air through a compressor inlet scroll strut. The sucked air is compressed by the compressor vanes and the compressor blades while passing through an interior of the compressor. The combustor receives the compressed air from the compressor and mixes the compressed air with fuel to form a fuel-air mixture. In addition, the combustor ignites the fuel-air mixture with an igniter to generate high-temperature and high-pressure combustion gas. The generated combustion gas is supplied to the turbine. In the turbine, a plurality of turbine vanes and turbine blades are arranged in a turbine casing. The combustion gas generated by the combustor passes through the turbine. While passing through an interior of the turbine, the combustion gas rotates the turbine blades and then is discharged to the outside through a turbine diffuser.

Among the turbomachines, the steam turbine includes an evaporator and a turbine. The evaporator heats water supplied from the outside to generate steam. In the turbine, a plurality of turbine vanes and turbine blades are alternately disposed in a turbine casing, similarly to the turbine in a gas turbine. However, in the turbine in the steam turbine, the steam generated in the evaporator, instead of the combustion gas, passes through the turbine to rotate the turbine blades.

As for the gas turbine, the combustor of the gas turbine is provided with a nozzle for mixing the fuel supplied from the outside and compressed air supplied from the compressor and injecting the air-fuel mixture into the combustor. In addition, a combustion chamber in which the air-fuel mixture is combusted in the combustor is disposed downstream of the nozzle, that is, on the downstream side on the basis of a flow direction of the air-fuel mixture.

At this time, according to the conventional gas turbine, when a material having a high flaming rate, such as hydrogen, is used as fuel, the flame generated in the combustion chamber may flow back forwards, that is, toward the upstream side on the basis of the flow direction of the air-fuel mixture. As the backflow occurs, there is a problem that flashback may occur in the nozzle, which damages the nozzle.

The foregoing is intended merely to aid in the understanding of the background of the present disclosure, and is not intended to mean that the present disclosure falls within the purview of the related art that is already known to those skilled in the art or to limit the scope the present invention according to f the present disclosure.

SUMMARY OF THE INVENTION

The present disclosure provides a combustor having an improved nozzle structure, one of the advantages of which is to prevent the flashback, in which a flame generated in a combustion chamber flows backward, from occurring in a nozzle.

According to an aspect of the present disclosure, there is provided a combustor mixing compressed air supplied from a compressor with fuel and combusting the compressed air-fuel mixture, the combustor including: an outer can into which the fuel is introduced from the outside; an outer head disposed on a front side of the outer can; an inner can disposed inside of the outer can so that the compressed air flows between the inner can and the outer can and having a combustion chamber in which a mixture of the fuel and the compressed air is combusted; and an inner head disposed in front of the inner can to mix the fuel and the compressed air and supply the mixture into the inner can, the inner head including: a head plate covering a front side of the inner can, and a plurality of nozzle assemblies disposed in front of the head plate to mix the fuel and the compressed air and supply the mixture rearwards, the nozzle assemblies each including: a nozzle head into which the fuel is introduced and a plurality of nozzles each arranged such that a front side thereof is coupled to the nozzle head and a rear side thereof is coupled to the head plate so as to mix the fuel and the compressed air and supply the mixture rearwards, wherein the nozzles has a shape with a diameter decreasing and increasing toward the rear side thereof.

According to another aspect of the present disclosure, there is provided a gas turbine including: a compressor provided to compress external air; a combustor provided to mix the compressed air supplied from the compressor with fuel and combust the compressed air-fuel mixture; and a turbine through which combustion gas supplied from the combustor flows to generate power for generating electricity, the combustor including: an outer can into which the fuel is introduced from the outside; an outer head disposed on a front side of the outer can; an inner can disposed inside of the outer can so that the compressed air flows between the inner can and the outer can and having a combustion chamber in which a mixture of the fuel and the compressed air is combusted; and an inner head disposed in front of the inner can to mix the fuel and the compressed air and supply the mixture into the inner can, the inner head including: a head plate covering a front side of the inner can, and a plurality of nozzle assemblies disposed in front of the head plate to mix the fuel and the compressed air and supply the mixture rearwards, the nozzle assemblies each including: a nozzle head into which the fuel is introduced and a plurality of nozzles each arranged such that a front side thereof is coupled to the nozzle head and a rear side thereof is coupled to the head plate so as to mix the fuel and the compressed air and supply the mixture rearwards, wherein the each nozzle has a shape with a diameter decreasing and increasing toward the rear side thereof.

The plurality of nozzle assemblies may be arranged such that one nozzle assembly from among the plurality of nozzle assemblies is disposed at the center portion of the head plate and the remaining nozzle assemblies from among the plurality of nozzle assemblies are disposed radially around the centrally disposed nozzle assembly, wherein the plurality of nozzles may be arranged such that one nozzles is disposed at the center portion of the nozzle head and the remaining nozzles are disposed radially around the centrally disposed nozzle.

The nozzle head may be formed in a hollow plate shape so that the fuel is introduced from a front side thereof, and the nozzles each may include a nozzle decreasing part disposed inside of the nozzle head and having a diameter decreasing toward a rear side thereof, with fuel holes formed through which the fuel introduced into the each nozzle is supplied into the nozzle decreasing part.

The each nozzle may further include a nozzle increasing part disposed on a rear side of the nozzle decreasing part so that fuel and compressed air are supplied from a front side thereof, and coupled to the head plate between the nozzle head and the head plate, the nozzle increasing part having a diameter increasing toward a rear side thereof.

The each nozzle may further include a nozzle inlet part connected to the front side of the nozzle decreasing part, protruding toward the front side of the nozzle head, and having a constant diameter in the front-rear direction, so as to transfer the compressed air introduced from the front side thereof to the nozzle decreasing part.

The each nozzle may further include a nozzle connection part connected between the nozzle decreasing part and the nozzle increasing part to supply fuel and compressed air from the nozzle decreasing part to the nozzle increasing part, the nozzle connection part having a constant diameter in the front-rear direction.

The nozzle increasing part may be provided with a plurality of air through-holes through which compressed air is radially introduced from the outside to the inside thereof, wherein the air through-holes are spaced apart from each other in the front-rear direction, the air through-holes each being formed in a radially inclined shape along the circumferential direction from the outside to the inside of the nozzle increasing part so that the compressed air supplied into the nozzle increasing part swirls.

The fuel holes may each be formed to be inclined rearwards on the basis of the direction of compressed air flowing in the nozzle decreasing part as it goes from the outside to the inside of the nozzle decreasing part in the radial direction.

According to the present disclosure, the nozzles each installed in front of the inner can is formed in a shape in which the diameter decreases and then increases from the front to the rear, and the fuel is supplied to the portion of the each nozzle where the diameter decreases, so that it is possible to prevent the flashback, in which a flame generated in the combustion chamber flows backward, from occurring in the each nozzle by using a phenomenon that a flow rate of a fluid increases in the nozzle portion where the diameter decreases.

Further, according to the present disclosure, the secondary compressed air is supplied to the nozzle portion where the diameter increases so that a fuel/air ratio of the fluid flowing adjacent to the inner circumferential surface of the nozzles is reduced, thereby preventing the flame generated in the combustion chamber from flowing backwards along the inner circumferential surface of the nozzles. Specifically, the secondary compressed air induces a swirl effect inside the nozzles to increase the fuel-air mixing efficiency such that the fuel/air ratio at the outlet of the nozzles appears in an M-shape due to the centrally-located primary compressed air and the radially-located fuel in the nozzles and the secondary compressed air outside the nozzles, which enables the low fuel/air ratio at the center of the nozzles to prevent the problem that the flame at the central part of the nozzles is introduced into the nozzles due to the inner recirculation occurring due to the swirl effect.

BRIEF DESCRIPTION OF THE DRAWINGS

FIG. 1 is a cross-sectional view illustrating a gas turbine according to the present disclosure;

FIG. 2 is a cut-away perspective view illustrating a combustor illustrated in FIG. 1;

FIG. 3 is a partially cut-away perspective view illustrating a nozzle assembly illustrated in FIG. 2 as viewed from the front side;

FIG. 4 is a cross-sectional view of a nozzle assembly, illustrating an embodiment of the present disclosure;

FIG. 5 is an enlarged view of part A in FIG. 4;

FIG. 6 is an enlarged view of part B in FIG. 4;

FIG. 7 is a cross-sectional view illustrating a nozzle increasing part as viewed along line C-C in FIG. 6; and FIG. 8 is a cross-sectional view of a part of a nozzle assemble illustrating another embodiment of the present disclosure.

DETAILED DESCRIPTION OF THE INVENTION

Although the present disclosure will be described with reference to embodiments illustrated in the accompanying drawings, those skilled in the art will understand that these embodiments are merely illustrative, and various modifications and equivalent other embodiments may be possible. Therefore, the true technical scope of the present disclosure should be defined by the technical scope of the appended claims.

Referring to FIG. 1, a gas turbine 10 includes a compressor 11, a combustor 100, and a turbine section 12. In a flow direction of gas (compressed air or combustion gas), the compressor 11 is disposed on the upstream side of the gas turbine 10, and the turbine section 12 is disposed on the downstream side of the gas turbine. In addition, the combustor 100 is arranged between the compressor 11 and the turbine section 12.

The compressor 11 accommodates, inside a compressor casing, compressor vanes and a compressor rotor including a compressor disk and compressor blades, and the turbine section 12 accommodates, inside a turbine casing, turbine vanes and a turbine rotor including a turbine disk and turbine blades. These compressor vanes and the compressor rotor are arranged in a multi-stage along a flow direction of compressed air, and the turbine vanes and the turbine rotor are also arranged in a multi-stage along a flow direction of combustion gas. At this time, it is designed such that the compressor 11 has an internal space of which the volume decreases from the front-stage toward the rear-stage so that the intake air can be compressed, whereas the turbine 12 has an internal space of which the volume increases from the front-stage toward the rear-stage so that the combustion gas supplied from the combustor 100 can expand.

Between the compressor rotor located on the rear end side of the compressor 100 and the turbine rotor located on the front end side of the turbine section 12, a torque tube is disposed as a torque transmission member to transmit the rotational torque generated by the turbine section 12 to the compressor 11. Although the torque tube may be composed of a plurality of torque tube disks arranged in three stages in total as illustrated in FIG. 1, this is only one of several embodiments of the present disclosure, so the torque tube may be composed of a plurality of torque tube disks arranged in four or more stages or two or less stages.

The compressor rotor includes a compressor disk and a compressor blade. A plurality of (e.g., 14) compressor disks are provided inside the compressor casing, and the respective compressor disks are fastened so as not to be spaced apart in the axial direction by a tie rod. More specifically, the respective compressor disks are aligned along the axial direction with the tie rod passing through the central portion thereof. In addition, adjacent compressor disks are arranged such that the opposing surfaces of the adjacent compressor disks are compressed by the tie rod so that the adjacent compressor disks cannot rotate relative to each other.

The plurality of compressor blades is radially coupled to an outer circumferential surface of the compressor disk in a multi-stage. Further, the plurality of compressor vanes is arranged in a multi-stage on an inner circumferential surface of the compressor casing such that each stage of compressor vanes is disposed between adjacent stages of compressor blades. Unlike the compressor disk, the compressor vanes maintain a fixed state so as not to rotate, and serve to guide the compressed air, which passed through an upstream-side stage of compressor blades, to a downstream-side stage of compressor blades. Here, the compressor casing and the compressor vanes may be collectively defined as a compressor stator to distinguish them from the compressor rotor.

The compressor stator further includes a compressor inlet scroll strut in addition to the compressor casing and the compressor vanes. The compressor inlet scroll strut is connected to a front side of the compressor casing to guide external air to an inlet of the compressor casing. Meanwhile, among the compressor vanes, the foremost compressor vane is referred to as an inlet guide vane. The inlet guide vane serves to guide the air flowing into the compressor casing to the compressor blades and the compressor vanes disposed on the rear side of the compressor casing.

The tie rod is arranged to penetrate the center of the plurality of compressor disks and turbine disks, which will be described later, such that one end thereof is fastened in the compressor disk located on the foremost side of the compressor 11 and the other end thereof is fastened by a fastening nut.

Since the tie rod may be formed in various structures depending on the gas turbine, the shape of the tie rod is not necessarily limited to the shape illustrated in FIG. 1. That is, as illustrated, one tie rod may have a form in which the tie rod passes through the central portion of the compressor disks and the turbine disks, or a form in which the plurality of tie rods are arranged in a circumferential manner, or a combination thereof.

Although not illustrated, the compressor of the gas turbine may be provided with a deswirler that serves as a guide for increasing a pressure of fluid and adjusting a flow angle of the fluid entering a combustor inlet to a designed flow angle.

The high-temperature and high-pressure combustion gas from the combustor 100 is supplied to the turbine section 12 described above. The high-temperature and high-pressure combustion gas supplied to the turbine section 12 expands while passing through the inside of the turbine section 12, and accordingly, impulses and reaction forces are applied to the turbine blades, which will be described later, to generate rotational torque.

The resultant rotational torque is transmitted to the compressor through the above-described torque tube, and an excess of the p ower required to drive the compressor is used to drive a generator or the like.

The turbine section 12 is fundamentally similar to the structure of a compressor 11. That is, the turbine section 12 is also provided with a plurality of turbine rotors similar to the compressor rotor of the compressor 11. Thus, the turbine rotor includes a turbine disk and a plurality of turbine blades radially disposed around the turbine disk. The plurality of turbine vanes is also annually arranged, on the basis of the same stage, on the turbine casing between adjacent stages of turbine blades to guide a flow direction of the combustion gas, which passed through the turbine blades. Here, the turbine casing and the turbine vanes may be collectively defined as a turbine stator to distinguish them from the turbine rotor.

Referring to FIG. 2, the combustor 100 according to the present disclosure includes an outer can 110, an outer head 111, an inner can 120, and an inner head 121. The outer can 110 is formed in a hollow cylindrical shape, into which fuel is introduced from the outside. The outer head 111 covers the outer can 110 at the front side of the outer can 110. The inner can 120 is disposed inside of the outer can 110, and has a hollow cylindrical shape. In addition, the compressed air flows from the rear to the front between the inner can 120 and the outer can 110, and fuel and compressed air are injected into the inner can from the front side. Then, as a mixture of the fuel and the compressed air injected into the inner can 120 is burned, a high-temperature and high-pressure flame and combustion gas are generated. Here, a space in which combustion takes place inside of the inner can 120 is referred to as a combustion chamber 112. The inner head 121 is installed at the front side of the inner can 120 to mix the supplied fuel with the compressed air and supply the fuel-compressed air mixture to the inside of the inner can 120.

Referring to FIGS. 2, 3 and 4, the inner head 121 includes a head plate 122 and a plurality of nozzle assemblies 123. The head plate 122 covers a front side of the inner can 120. The plurality of nozzle assemblies 123 is installed in front of the head plate 122 to mix fuel and compressed air and supply the mixture toward the rear side. The nozzle assemblies 123 each include a nozzle head 124 and a plurality of nozzles 130. The nozzle head 124 is spaced apart from the front side of the head plate 122, and fuel is introduced into the nozzle head 124. The plurality of nozzles 130 may be provided such that front ends thereof are coupled to the nozzle head 124 and rear ends thereof are coupled to the head plate 122 so as to mix the supplied fuel and compressed air and supply the mixture toward the rear side. At this time, the nozzles 130 may be formed in a shape that decreases and then increases in diameter from the front side to the rear side.

Referring to FIGS. 2 and 3, according to an embodiment, the plurality of nozzle assemblies 123 may be arranged such that one nozzle assembly is disposed at the center portion of the head plate 122 and the remaining nozzle assemblies 123 are disposed radially around the central nozzle assembly 123. In addition, the plurality of nozzles 130 may be arranged such that one nozzle is disposed at the center portion of the nozzle head 124 and the remaining nozzles 130 are disposed radially around the nozzle 130 disposed at the center portion of the nozzle head 124.

Referring to FIGS. 3, 4 and 5, the nozzle head 124 is formed in a hollow plate shape so that fuel is introduced from a front side thereof. According to an embodiment, the nozzle 130 each may include a nozzle decreasing part 131, a nozzle increasing part 132, a nozzle inlet part 133, and a nozzle connection part 134.

The nozzle decreasing part 131 may have a diameter, that decreases toward the rear side (i.e., toward the downstream side of the flow direction), is disposed inside of the nozzle head 124, and has fuel holes through which the fuel introduced into the each nozzle 130 is supplied into the nozzle decreasing part. The fuel holes 135 may be provided to be spaced apart from each other in a circumferential direction of the nozzle decreasing part 131. According to an embodiment, the nozzle increasing part 132, that is disposed on the rear side of the nozzle decreasing part 131, may be supplied with fuel and compressed air from the front side, and may be coupled to the head plate 122 between the nozzle head 124 and the head plate 122. The nozzle increasing part may have a diameter that increases toward the rear side.

The nozzle inlet part 133 is connected to the front side of the nozzle decreasing part 131, may protrude forward of the nozzle head 124 (i.e., toward the upstream side of the flow direction), may have a constant diameter in a front-rear direction, and transfers the compressed air introduced from the front side to the nozzle decreasing part 131. According to an embodiment, the nozzle connection part 134 is connected to the nozzle decreasing part 131 and the nozzle increasing part 132 and located therebetween, supplies fuel and compressed air from the nozzle decreasing part 131 to the nozzle increasing part 132, and may have a constant diameter in the front-rear direction.

The nozzle increasing part 132 is provided with air through-holes 136 through which compressed air is radially introduced from the outside to the inside thereof. The air through-holes 136 are spaced apart from each other in the circumferential direction of the nozzle increasing part 132. In addition, the air through-holes 136 may be provided in a plurality of rows spaced apart from each other in the front-rear direction, that is, along a flow direction of a fluid flowing inside of the nozzle increasing part 132. The air through-holes 136 each may be formed in a radially inclined shape along the circumferential direction from the outside to the inside of the nozzle increasing part 132 so that the compressed air supplied into the nozzle increasing part 132 swirls.

Referring to FIGS. 2 to 4, the compressed air introduced forward of the nozzle assembly 123 through the space between the inner can 120 and the outer can 110 flows to the front side of the nozzle inlet part 133 and then to the nozzle decreasing part 131. Further, the fuel flows into the outer can 110 from the outside, and then flows into the nozzle head 124. It is noted that a pipeline for supplying fuel from the outside to the nozzle head 124 is omitted from the drawings. The fuel introduced into the nozzle head 124 is supplied into the nozzle decreasing part 131 through the plurality of fuel holes 135. Then, the fuel and the compressed air are mixed in the nozzle decreasing part 131 and then supplied to the nozzle increasing part 132 through the nozzle connection part 134.

Referring to FIG. 5, since the diameter of the nozzle decreasing part 131 gradually decreases toward the rear side, a flow of the compressed air in the nozzle decreasing part 131 converges radially inwards in the nozzle decreasing part 131. Then, a flow rate of the compressed air in the nozzle decreasing part 131 increases as the compressed air flows toward the rear side of the nozzle decreasing part 131. Further, according to an embodiment, the fuel may be supplied to such a portion where the flow rate of the compressed air increases. In this case, it is possible to prevent the flashback from occurring on the inner circumferential surface of the nozzle decreasing part 131.

Referring to FIGS. 6 and 7, the fuel-compressed air mixture supplied to the nozzle increasing part 132 is supplied to the rear side, passes through the head plate 122 and then is injected into the combustion chamber 112. At this time, a portion of the compressed air supplied to the front side of the head plate 122 through the space between the inner can 120 and the outer can 110 may be introduced into the nozzle increasing part 132 from the outside of the each nozzle 130 through the plurality of air through-holes 136. The air through-holes 136 each may be formed in a radially inclined shape along the circumferential direction from the outside to the inside of the nozzle increasing part 132 so that the compressed air supplied into the nozzle increasing part 132 swirls.

In the internal space of the nozzle decreasing part 131, the central portion thereof may have a fuel-to-air ratio relatively lower than that of a portion adjacent to the inner circumferential surface. That is, in the internal space of the nozzle decreasing part 131, the fuel-to-air ratio increases from the central portion to the portion adjacent to the inner circumferential surface. This is because fuel is supplied to the inner circumferential surface of the nozzle decreasing part 131 through the plurality of fuel holes 135. In the internal space of the nozzle increasing part 132, the fuel-to-air ratio may increase and then decrease from the central portion to the portion adjacent to the inner circumferential surface. This is because, contrary to the nozzle decreasing part 131, in the nozzle increasing part 132, compressed air, not fuel, is supplied to the inner circumferential surface.

Therefore, since the portion adjacent inner circumferential surface of the nozzle increasing part 132 has a relatively large air-to-fuel ratio, it is possible to prevent the flashback from occurring. In addition, since a swirl is formed in a flow of compressed air flowing into the nozzle increasing part 132 through the plurality of air through-holes 136, fuel and the compressed air in the nozzle increasing part 132 can be mixed more uniformly and effectively, and the inner circumferential surface of the nozzle increasing part 132 can be protected from a flame generated in the combustion chamber 112. When the compressed air flowing into the nozzle inlet part 133 is referred to as primary compressed air and the compressed air flowing through the air through-holes 136 is referred to as secondary compressed air, due to the influence of the inner recirculation generated by the swirl by the secondary compressed air, a problem may occur that a flame at the central portion of the each nozzle 130 is introduced into the nozzle section, in other words, to the direction of the nozzle inlet part 133. This problem may be prevented by the configuration that allows the central portion of the each nozzle 130 to maintain a low fuel/air ratio and the air recirculation region in the the each nozzle 130 to be pushed back, with an axial velocity of the primary compressed air at the central portion of the each nozzle 130.

Referring to FIG. 5, in an exemplary embodiment of the present disclosure, each of the fuel holes 135 may be formed along the radial direction of the nozzle decreasing part 131, that is, orthogonal to a direction of a fluid flowing around the central portion in the internal space of the nozzle decreasing part 131. Referring to FIG. 8, in another embodiment of the present disclosure, the fuel holes 135 may each be formed to be inclined rearwards on the basis of the direction of compressed air flowing in the nozzle decreasing part 131 as it goes from the outside to the inside of the nozzle decreasing part 131 in the radial direction.

Although the present disclosure has been described with reference to the embodiments illustrated in the drawings, the described embodiments are merely illustrative, so those skilled in the art will understand that various modifications and equivalents thereof can be made therefrom. Therefore, the true technical scope of the present disclosure should be determined by the technical spirit of the appended claims.

The invention claimed is:

1. A combustor mixing compressed air supplied from a compressor with fuel and combusting the compressed air-fuel mixture, the combustor comprising:

an outer can into which the fuel is introduced from the outside;

an outer head disposed on a front side of the outer can;

an inner can disposed inside of the outer can so that the compressed air flows between the inner can and the outer can and having a combustion chamber in which a mixture of the fuel and the compressed air is combusted; and an inner head disposed in front of the inner can to mix the fuel and the compressed air and supply the mixture into the inner can, the inner head comprising:

a head plate covering a front side of the inner can; and a plurality of nozzle assemblies disposed in front of the head plate to mix the fuel and the compressed air and supply the mixture rearwards, the nozzle assemblies each comprising:

a nozzle head into which the fuel is introduced; and a plurality of nozzles each arranged such that a front side thereof is coupled to the nozzle head and a rear side thereof is coupled to the head plate so as to mix the fuel and the compressed air and supply the mixture rearwards, wherein the each nozzle has a hollow cylindrical shape, and a form in which a diameter decreases and increases toward the rear side thereof, with an outlet of the each nozzle being wider than an inlet thereof.

2. The combustor according to claim 1, wherein the plurality of nozzle assemblies are arranged such that one nozzle assembly from among the plurality of nozzle assemblies is disposed at the center portion of the head plate and the remaining nozzle assemblies from among the plurality of nozzle assemblies are disposed radially around the centrally disposed nozzle assembly, wherein the plurality of nozzles are arranged such that one nozzle is disposed at the center portion of the nozzle head and the remaining nozzles are disposed radially around the centrally disposed nozzle.

3. The combustor according to claim 1, wherein the nozzle head is formed in a hollow plate shape so that the fuel is introduced from a front side thereof, and the nozzles each comprises a nozzle decreasing part disposed inside of the nozzle head and having a diameter decreasing toward a rear side thereof, with fuel holes formed through which the fuel introduced into the each nozzle is supplied into the nozzle decreasing part.

4. The combustor according to claim 3, wherein the each nozzle further comprises a nozzle increasing part disposed on a rear side of the nozzle decreasing part so that fuel and compressed air are supplied from a front side thereof, and coupled to the head plate between the nozzle head and the head plate, the nozzle increasing part having a diameter increasing toward a rear side thereof.

5. The combustor according to claim 3, wherein the inlet is connected to the front side of the nozzle decreasing part, protruding toward the front side of the nozzle head, and having a constant diameter in the front-rear direction, so as to transfer the compressed air introduced from the front side thereof to the nozzle decreasing part.

6. The combustor according to claim 4, wherein the each nozzle further comprises a nozzle connection part connected between the nozzle decreasing part and the nozzle increasing part to supply fuel and compressed air from the nozzle decreasing part to the nozzle increasing part, the nozzle connection part having a constant diameter in the front-rear direction.

7. The combustor according to claim 4, wherein the nozzle increasing part is provided with a plurality of air through-holes through which compressed air is radially introduced from the outside to the inside thereof, wherein the air through-holes are spaced apart from each other in the front-rear direction, the air through-holes each being formed in a radially inclined shape along the circumferential direction from the outside to the inside of the nozzle increasing part so that the compressed air supplied into the nozzle increasing part swirls.

8. The combustor according to claim 3, wherein the fuel holes each are formed to be inclined rearwards on the basis of the direction of compressed air flowing in the nozzle decreasing part as it goes from the outside to the inside of the nozzle decreasing part in the radial direction.

9. A gas turbine comprising:

a compressor provided to compress external air;

a combustor provided to mix the compressed air supplied from the compressor with fuel and combust the compressed air-fuel mixture; and a turbine through which combustion gas supplied from the combustor flows to generate power for generating electricity, wherein the combustor comprises:

an outer can into which the fuel is introduced from the outside;

an outer head disposed on a front side of the outer can;

an inner can disposed inside of the outer can so that the compressed air flows between the inner can and the outer can and having a combustion chamber in which a mixture of the fuel and the compressed air is combusted; and an inner head disposed in front of the inner can to mix the fuel and the compressed air and supply the mixture into the inner can, the inner head comprising a head plate covering a front side of the inner can; and a plurality of nozzle assemblies disposed in front of the head plate to mix the fuel and the compressed air and supply the mixture rearwards, the nozzle assemblies each comprising:

a nozzle head into which the fuel is introduced; and a plurality of nozzles each arranged such that a front side thereof is coupled to the nozzle head and a rear side thereof is coupled to the head plate so as to mix the fuel and the compressed air and supply the mixture rearwards, wherein the each nozzle has a hollow cylindrical shape, and a form in which a diameter decreases and increases toward the rear side thereof, with an outlet of the each nozzle being wider than an inlet thereof.

10. The gas turbine according to claim 9, wherein the plurality of nozzle assemblies are arranged such that one nozzle assembly from among the plurality of nozzle assemblies is disposed at the center portion of the head plate and the remaining nozzle assemblies from among the plurality of nozzle assemblies are disposed radially around the central nozzle assembly, wherein the plurality of nozzles are arranged such that one nozzle is disposed at the center portion of the nozzle head and the remaining nozzles are disposed radially around the centrally disposed nozzle.

11. The gas turbine according to claim 9, wherein the nozzle head is formed in a hollow plate shape so that the fuel is introduced from a front side thereof, and the nozzles each comprises a nozzle decreasing part disposed inside of the nozzle head and having a diameter decreasing toward a rear side thereof, with fuel holes formed through which the fuel introduced into the each nozzle is supplied into the nozzle decreasing part.

12. The gas turbine according to claim 11, wherein the each nozzle further comprises a nozzle increasing part disposed on a rear side of the nozzle decreasing part so that fuel and compressed air are supplied from a front side thereof, and coupled to the head plate between the nozzle head and the head plate, the nozzle increasing part having a diameter increasing toward a rear side thereof.

13. The gas turbine according to claim 11, wherein the inlet is connected to the front side of the nozzle decreasing part, protruding toward the front side of the nozzle head, and having a constant diameter in the front-rear direction, so as to transfer the compressed air introduced from the front side thereof to the nozzle decreasing part.

14. The gas turbine according to claim 12, wherein the each nozzle further comprises a nozzle connection part connected between the nozzle decreasing part and the nozzle increasing part to supply fuel and compressed air from the nozzle decreasing part to the nozzle increasing part, the nozzle connection part having a constant diameter in the front-rear direction.

15. The gas turbine according to claim 12, wherein the nozzle increasing part is provided with a plurality of air through-holes through which compressed air is radially introduced from the outside to the inside thereof, wherein the air through-holes are spaced apart from each other in the front-rear direction, the air through-holes each being formed in a radially inclined shape along the circumferential direction from the outside to the inside of the nozzle increasing part so that the compressed air supplied into the nozzle increasing part swirls.

16. The gas turbine according to claim 11, wherein the fuel holes each are formed to be inclined rearwards on the basis of the direction of compressed air flowing in the nozzle decreasing part as it goes from the outside to the inside of the nozzle decreasing part in the radial direction.

17. An inner head provided in a combustor to mix compressed air supplied from a compressor with fuel and combust the mixture, the inner head comprising a head plate, through which the compressed air flows, covering a front side of an inner can having a combustion chamber in which a mixture of the fuel and the compressed air is combusted; and a plurality of nozzle assemblies disposed in front of the head plate to mix the fuel and the compressed air and supply the mixture rearwards, the nozzle assemblies each comprising:

a nozzle head into which the fuel is introduced; and a plurality of nozzles each arranged such that a front side thereof is coupled to the nozzle head and a rear side thereof is coupled to the head plate so as to mix the fuel and the compressed air and supply the mixture rearwards, wherein the each nozzle has a hollow cylindrical shape, and a form in which a diameter decreases and increases toward the rear side thereof, with an outlet of the each nozzle being wider than an inlet thereof.

18. The inner head according to claim 17, wherein the plurality of nozzle assemblies are arranged such that one nozzle assembly from among the plurality of nozzle assemblies is disposed at the center portion of the head plate and the remaining nozzle assemblies from among the plurality of nozzle assemblies are disposed radially around the centrally disposed nozzle assembly, wherein the plurality of nozzles are arranged such that one nozzle is disposed at the center portion of the nozzle head and the remaining nozzles are disposed radially around the centrally disposed nozzles.

19. The inner head according to claim 17, wherein the nozzle head is formed in a hollow plate shape so that the fuel is introduced from a front side thereof, and the nozzles each comprises a nozzle decreasing part disposed inside of the nozzle head and having a diameter decreasing toward a rear side thereof, with fuel holes formed through which the fuel introduced into the each nozzle is supplied into the nozzle decreasing part.

20. The inner head according to claim 19, wherein the nozzles further comprises a nozzle increasing part disposed on a rear side of the nozzle decreasing part so that fuel and compressed air are supplied from a front side thereof, and coupled to the head plate between the nozzle head and the head plate, the nozzle increasing part having a diameter increasing toward a rear side thereof.

* * * * *